US007565868B2

(12) United States Patent
Relland

(10) Patent No.: US 7,565,868 B2
(45) Date of Patent: Jul. 28, 2009

(54) RIG MAT

(76) Inventor: Peter Relland, P.O. Box 340, New Sarepta, AB (CA) T0B 3M0

( * ) Notice: Subject to any disclaimer, the term of this patent is extended or adjusted under 35 U.S.C. 154(b) by 0 days.

(21) Appl. No.: 11/848,061

(22) Filed: Aug. 30, 2007

(65) Prior Publication Data

US 2008/0053343 A1 Mar. 6, 2008

(30) Foreign Application Priority Data

Sep. 6, 2006 (CA) ..... 2558988

(51) Int. Cl.
*B65D 19/00* (2006.01)

(52) U.S. Cl. ..... 108/51.11; 108/57.32; 108/55.1

(58) Field of Classification Search ..... 108/51.11, 108/55.2, 55.3, 55.5, 57.28, 57.2, 57.21, 108/57.22, 57.23, 57.24, 57.29, 57.3, 57.31, 108/57.32; 206/386, 599, 600; 248/346.02
See application file for complete search history.

(56) References Cited

U.S. PATENT DOCUMENTS

| | | | | | |
|---|---|---|---|---|---|
| 1,618,257 | A * | 2/1927 | Young | 108/55.1 |
| 3,857,494 | A * | 12/1974 | Giardini | 108/55.1 |
| 4,305,505 | A * | 12/1981 | Hickey | 108/55.1 |
| 4,347,794 | A * | 9/1982 | Nordstrom | 108/57.15 |
| 4,834,000 | A * | 5/1989 | Darnell et al. | 108/57.15 |
| 5,092,541 | A * | 3/1992 | Tofflemire et al. | 108/55.1 |
| 5,755,472 | A * | 5/1998 | Clive-Smith | 108/55.1 |
| 6,216,607 | B1 * | 4/2001 | Cuddy | 108/55.5 |
| 6,422,405 | B1 * | 7/2002 | Haenszel | 108/55.1 |
| 6,543,370 | B2 * | 4/2003 | Bae | 108/55.1 |
| 6,694,894 | B1 * | 2/2004 | Darnell | 108/53.1 |
| 6,938,557 | B1 * | 9/2005 | Grigsby, Jr. | 108/51.11 |
| 7,308,857 | B2 * | 12/2007 | Moore et al. | 108/51.1 |

* cited by examiner

*Primary Examiner*—José V Chen
(74) *Attorney, Agent, or Firm*—Sheridan Ross P.C.

(57) ABSTRACT

Gusset plates are incorporated for reinforcement at the junctions of the wide flanged, cross and longitudinal beams of a rig mat frame. The junctions thus have a square tubing configuration.

2 Claims, 5 Drawing Sheets

RIG MAT

FIELD OF THE INVENTION

The present invention relates to a frame for a rig mat.

BACKGROUND OF THE INVENTION

Rig mats are used to form a base on which to support a drilling rig. The rig mats distribute the load of the rig and are particularly useful when the rig is on soft ground.

The present invention is concerned with a type of known rig mat that comprises a rectangular steel grid of wide flanged beams. The grid is formed by spaced apart, longitudinally extending beams connected to transversely extending cross beams welded thereto. The openings between the steel beams are filled in with thick wooden beams seated on the lower flanges.

The rig mats must support a lot of weight and the underlying ground is often not uniformly supportive. Therefore bending of the grid when loaded can be a problem.

SUMMARY OF THE INVENTION

In accordance with the invention, the end portions of the cross beams of the grid are modified by welding upright rectangular gusset plates along their top and bottom edges to the top and bottom flanges. As a result the cross beam end portion is given a 'square tubing' configuration.

In this manner, the junction, where a cross beam is connected with a longitudinally extending beam, is significantly strengthened and rigidified.

Preferably, the construction is improved by welding an end edge of each gusset plate to the web of the longitudinal beam, to further strengthen and rigidify the junction.

DESCRIPTION OF THE PREFERRED EMBODIMENT

Figure 1:
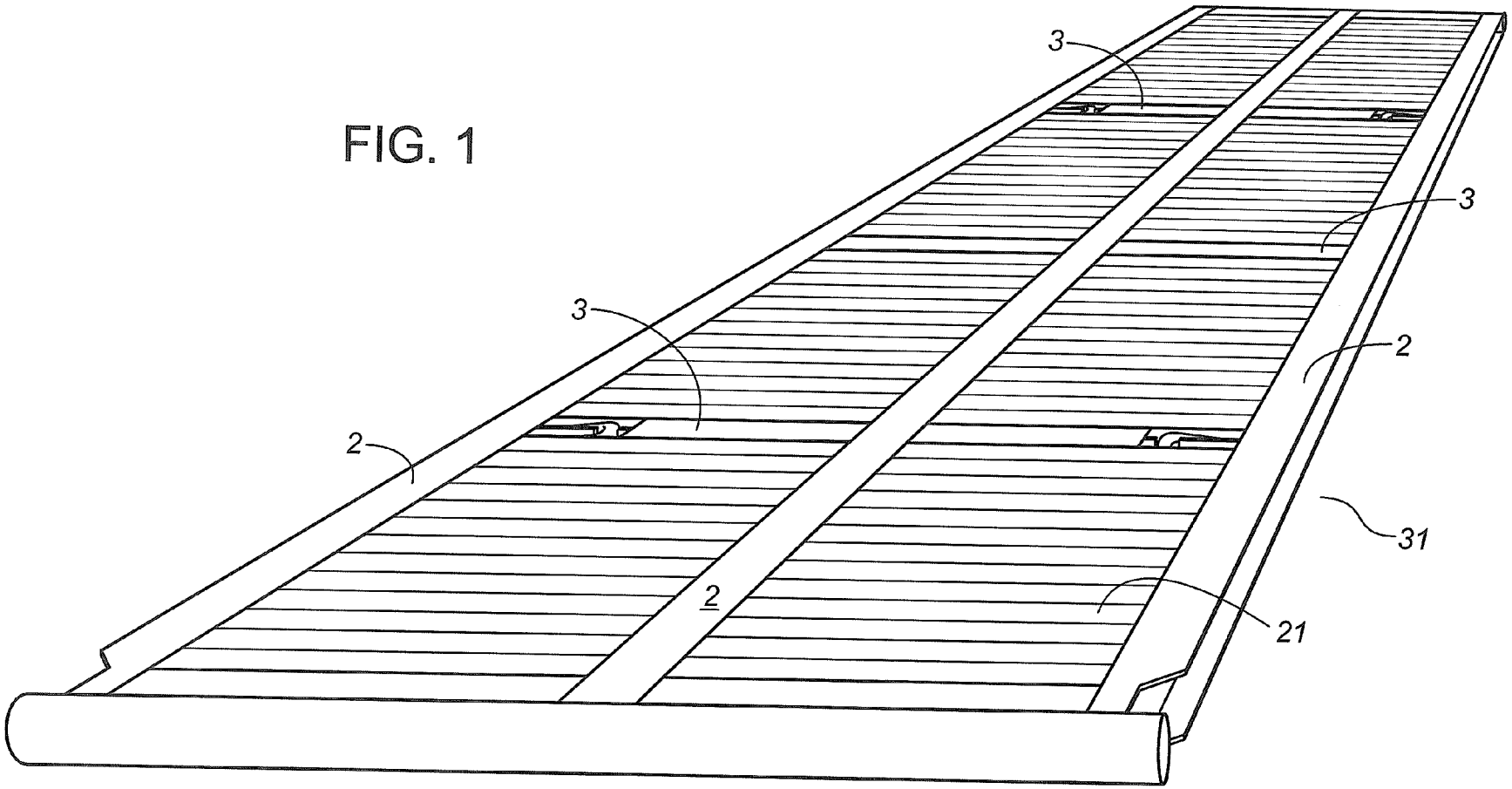
FIG. 1 is a perspective view showing a rig mat.
Figure 2:
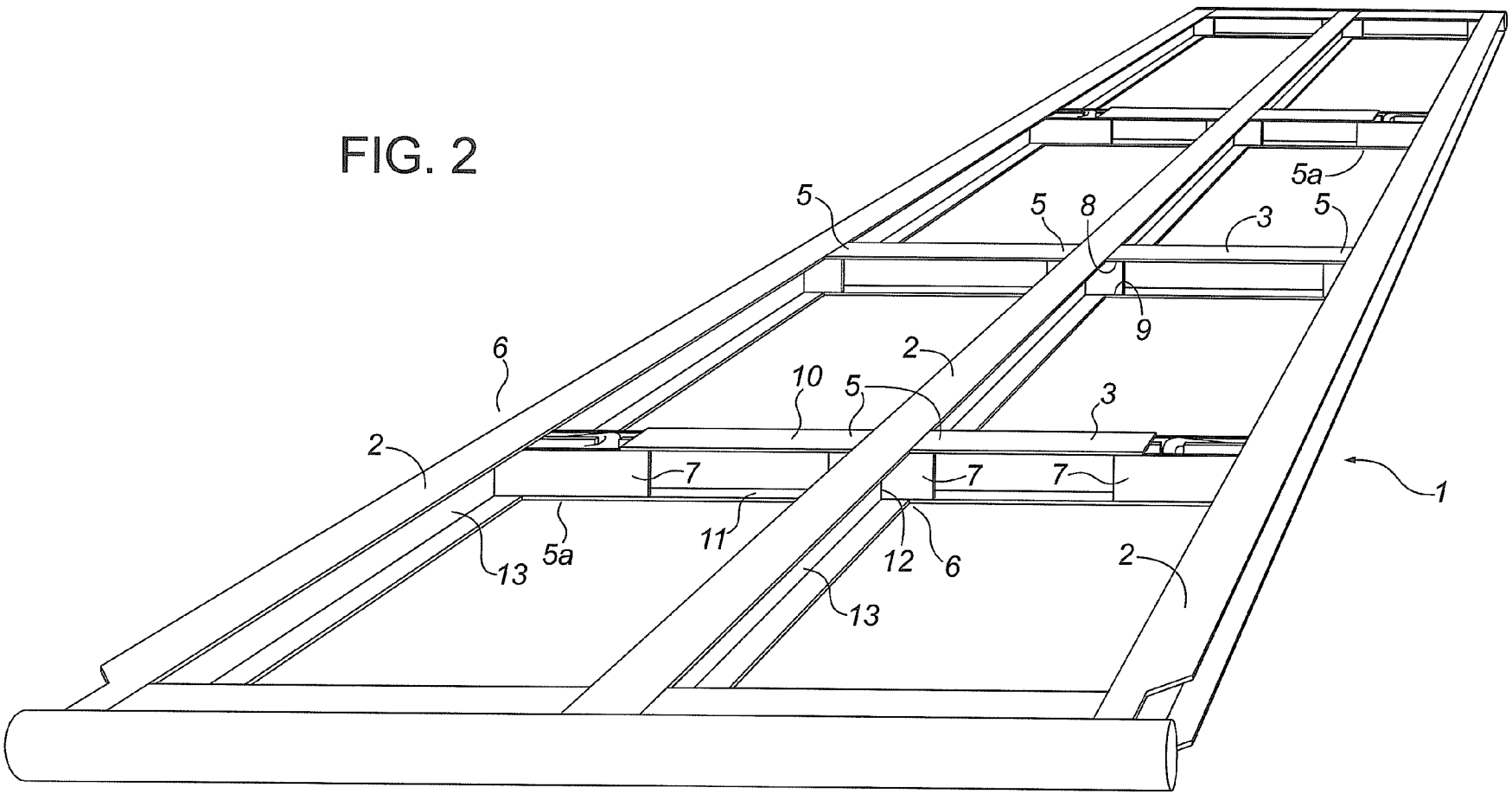
FIG. 2 is a perspective view showing a rig mat grid modified in accordance with the invention by the inclusion of gusset plate reinforcement at the junctions of cross beams and longitudinal beams.
Figure 3:
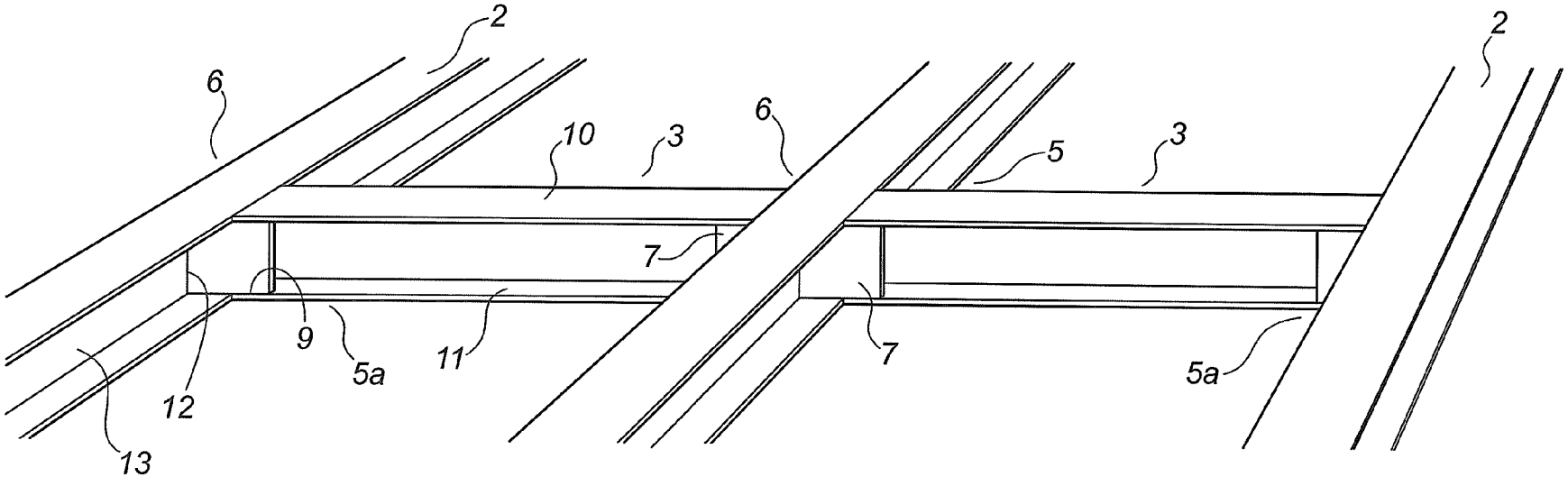
FIG. 3 is a perspective expanded view of such junctions.
Figure 4:
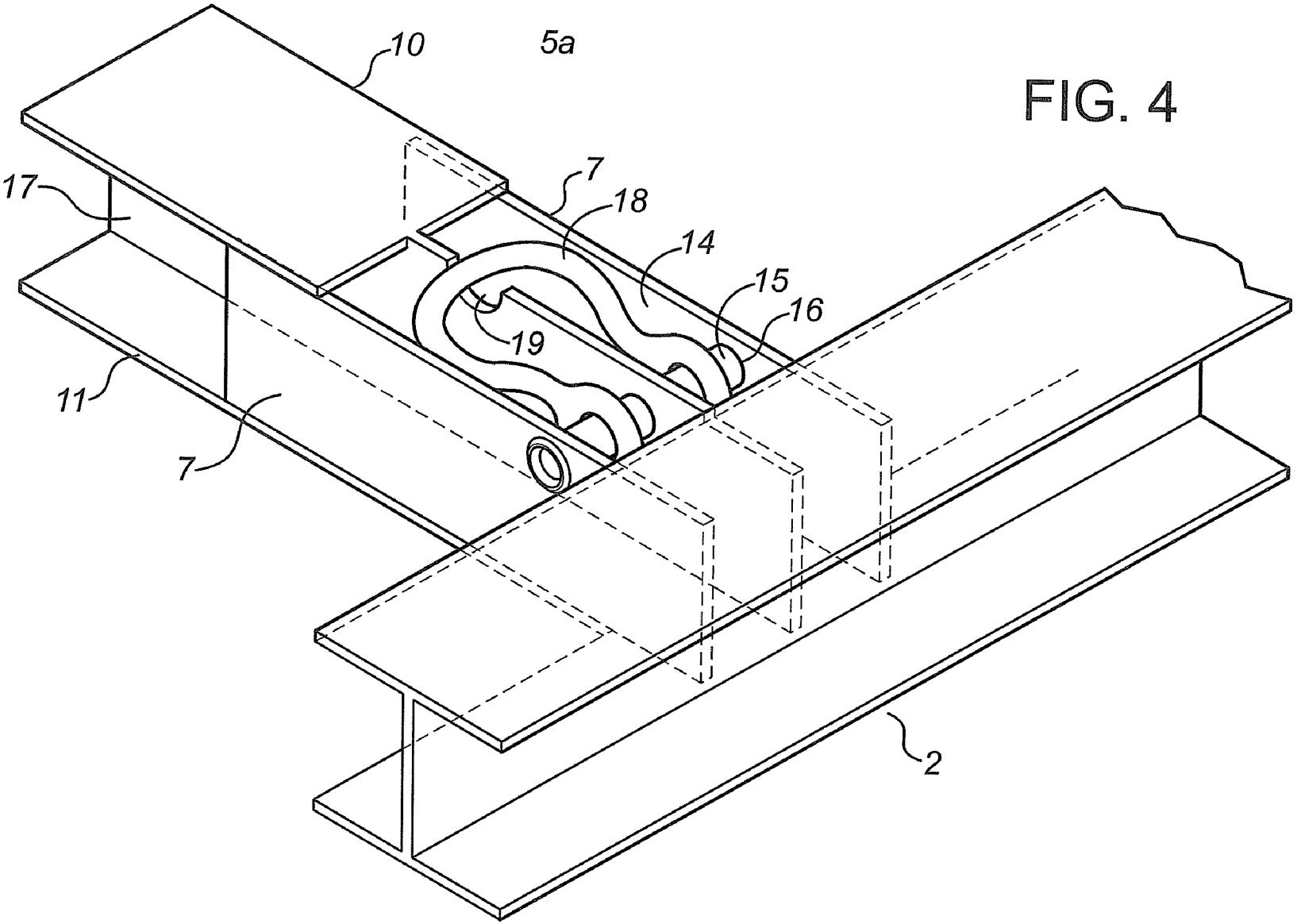
FIG. 4 is a perspective expanded view of a junction having a lifting assembly.
Figure 5:
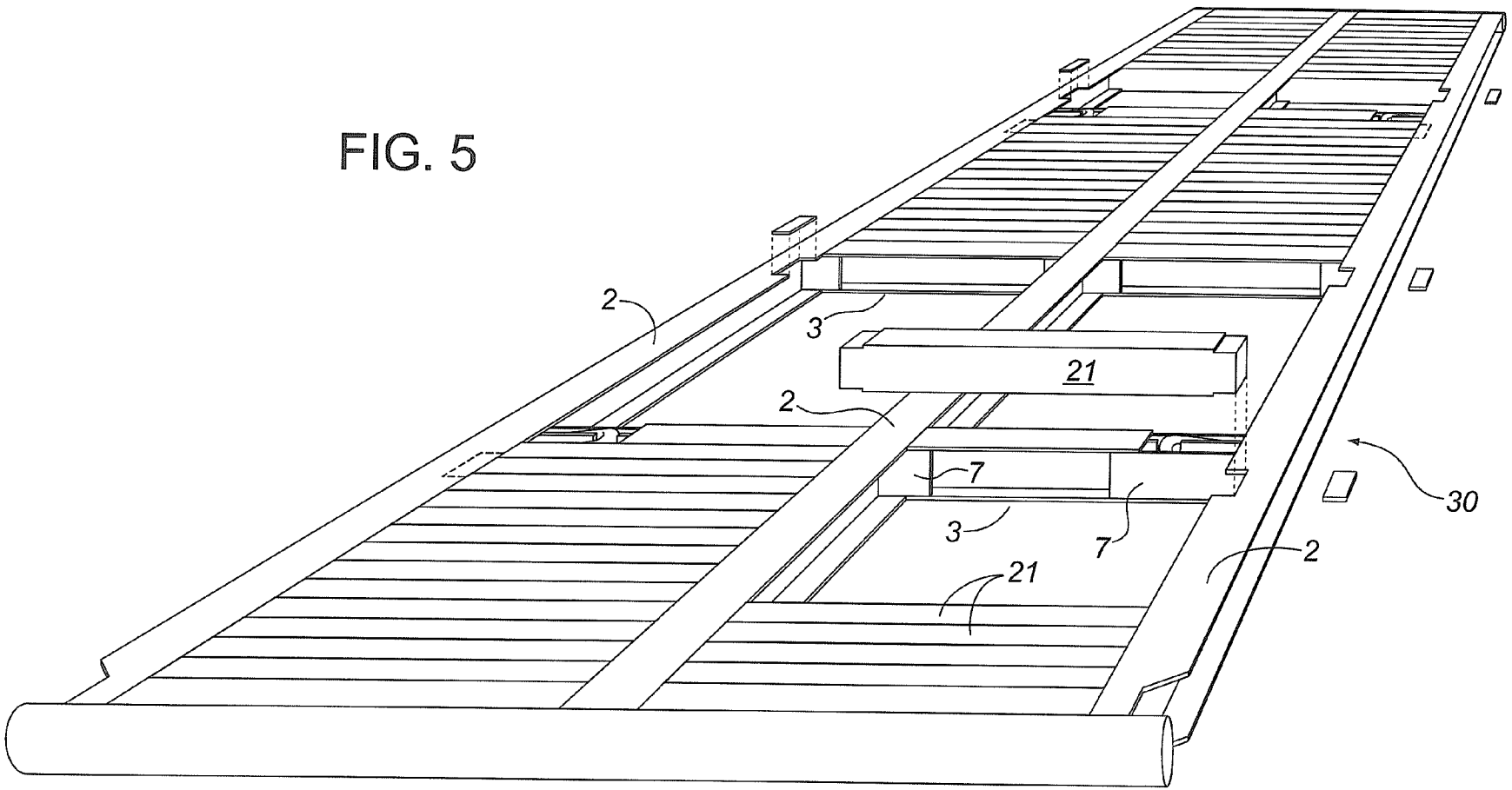
FIG. 5 is a perspective view showing the grid of FIG. 2 partly filled in with wooden beams.

The purpose of the invention is to rigidify and strengthen the frame 30 of a rig mat 31 to improve its durability in use. The frame 30 comprises a grid 1. The grid 1 is reinforced with gusset plates 7 at the junctions 6 of cross beams 3 and longitudinal beams 2. The so reinforced junctions 6 have a square tubing configuration.

More particularly, in the embodiment shown in the drawings, there is provided a rectangular grid 1 formed by spaced apart, wide flanged, steel longitudinal beams 2 connected with wide flanged steel, cross beams 3. The longitudinal and cross beams 2, 3 are connected by welds. The cross beams 3 have end portions 5 that meet the longitudinal beams 2 at junctions 6.

Rectangular, steel gusset plates 7 are welded along their top and bottom edges 8, 9 to the top and bottom flanges 10, 11 of the cross beam end portions 5, so that the end portions have a square tubing configuration. Preferably, the gusset plates 7 are also welded along their end edges 12 to the webs 13 of the adjacent longitudinally extending beams 2.

Some of the cross beam end portions 5 that connect with the longitudinally extending side beams 2 of the grid 1, are referred to herein as lift end portions 5*a*. The top flange 10 of each lift end portion 5*a* is removed or set back from the adjacent longitudinal beam side 2 to form an opening 14. A pin 15 extends through holes 16 formed in the gusset plates 7 and the web 17 of each lift end portion 5*a*. The pin 15 is welded in place. A shackle 18 is pivotally mounted on the pin 15 and can seat in a recess 19 cut in the web 17. The pin 15 is therefore supported by three members (the gusset plates 7 and web 17) for durability.

The grid 1, incorporating cross beam end portions 5 having a square tubing configuration, therefore provides a reinforced frame 30 for receiving wooden beams 21 to form a rig mat.

What is claimed is:

1. A steel frame for a rig mat, comprising:

a rectangular grid of wide flanged steel I-beams comprising longitudinally extending beams and transversely extending cross beams, each beam having a web and top and bottom flanges;

each cross beam having end portions welded to an adjacent pair of longitudinally extending beams to form junctions therewith;

a pair of upright rectangular gusset plates associated with each cross beam end portion, each gusset plate having top, bottom and end edges, said top and bottom edges being welded to the flanges of the cross beam end portion so as to combine therewith to form an end portion of square tubing configuration; and the plurality of cross beam end portions, connected with the longitudinally extending beams forming the sides of the grid, include opposed pairs of lift end portions, the top flange of each such lift end portion being set back from the adjacent longitudinally extending beam to form an opening, said lift end portion comprising (i) a pin located in the opening and extending through and being supported by the gusset plates and the web of the end portion; and (ii) a shackle pivotally mounted on the pin.

2. The frame of claim 1 wherein each gusset plate is welded along one end edge to the web of an adjacent longitudinally extending beam.

* * * * *